US011827411B1

(12) United States Patent
Rosas

(10) Patent No.: US 11,827,411 B1
(45) Date of Patent: Nov. 28, 2023

(54) BEVERAGE BOTTLE WITH REMOVABLE BOTTOM

(71) Applicant: Miguel Rosas, Dallas, TX (US)

(72) Inventor: Miguel Rosas, Dallas, TX (US)

( * ) Notice: Subject to any disclaimer, the term of this patent is extended or adjusted under 35 U.S.C. 154(b) by 0 days.

(21) Appl. No.: 17/513,429

(22) Filed: Oct. 28, 2021

(51) Int. Cl.
*B65D 1/06* (2006.01)

(52) U.S. Cl.
CPC ..... *B65D 1/06* (2013.01)

(58) Field of Classification Search
CPC ..... B65D 1/06; B65D 1/0269; B65D 1/0261; B65D 1/40; B65D 7/22; B65D 7/12; B65D 2501/24146; Y10S 206/804
USPC ..... 220/625, 630, 628, 62.18, 62.17, 615, 220/610, 611, 4.21, 592.27; 215/378
See application file for complete search history.

(56) References Cited

U.S. PATENT DOCUMENTS 509,440 A * 11/1893 Marzynski ..... B65D 7/22 220/62.18
1,511,852 A * 10/1924 Wagner ..... A47J 41/028 220/592.2
1,566,221 A * 12/1925 Lindemuth ..... A47J 41/028 220/592.27
3,405,862 A * 10/1968 Spyra ..... B65D 11/00 229/5.5
3,835,580 A * 9/1974 Keces ..... A63H 33/32 220/4.21
4,300,612 A * 11/1981 Schroeder, Jr. .... B65D 23/0885 220/675
4,811,858 A * 3/1989 Augur ..... B65D 81/3886 220/4.21
2010/0078432 A1* 4/2010 Lin ..... A47G 19/2272 220/23.91
2011/0132893 A1* 6/2011 Lin ..... A45F 3/18 220/592.27
2012/0241446 A1* 9/2012 Schwartz ..... B65D 7/04 220/601
2013/0213978 A1* 8/2013 Libourel ..... A47J 41/02 220/592.2

* cited by examiner

*Primary Examiner* — Robert J Hicks
(74) *Attorney, Agent, or Firm* — Leavitt Eldredge Law Firm

(57) ABSTRACT

A beverage bottle includes a body defining an interior cavity and a lid configured to removably couple to the body. The body also includes a neck portion having a mouth opening; a top section; and a bottom section configured to removably couple to the top section via a fastening mechanism. The bottom section is further configured with a large volume to contain one or more consumables.

3 Claims, 3 Drawing Sheets

BEVERAGE BOTTLE WITH REMOVABLE BOTTOM

BACKGROUND

1. Field of the Invention

The present invention relates generally to beverage bottles, and more specifically to a beverage bottle having a removable bottom to allow for easy cleaning.

2. Description of Related Art

Beverage bottles are well known in the art and are effective means to contain a consumable liquid. Commonly in the art, users carry beverage bottles for hydration as they go about their day. For example, FIG. 1 depicts a conventional beverage bottle 101 having a body 103 with a narrow top 105 and a lid 107. During use, a user will remove the lid 107 and take a drink through the narrow top 105. As desired, the user may refill the beverage bottle 101 with more consumable liquid to save costs and reduce waste.

One of the problems commonly associated with the conventional beverage bottle 101 is that it is difficult to effectively clean for reuse. Because the narrow top 105 is a small opening, it is difficult for users to insert cleaning devices to thoroughly scrub the interior cavity of the body 103. While long and thin cleaning brushes have been developed to aid in cleaning beverage bottles, none are able to clean the inside cavity effectively.

Accordingly, although great strides have been made in the area of beverage bottles, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
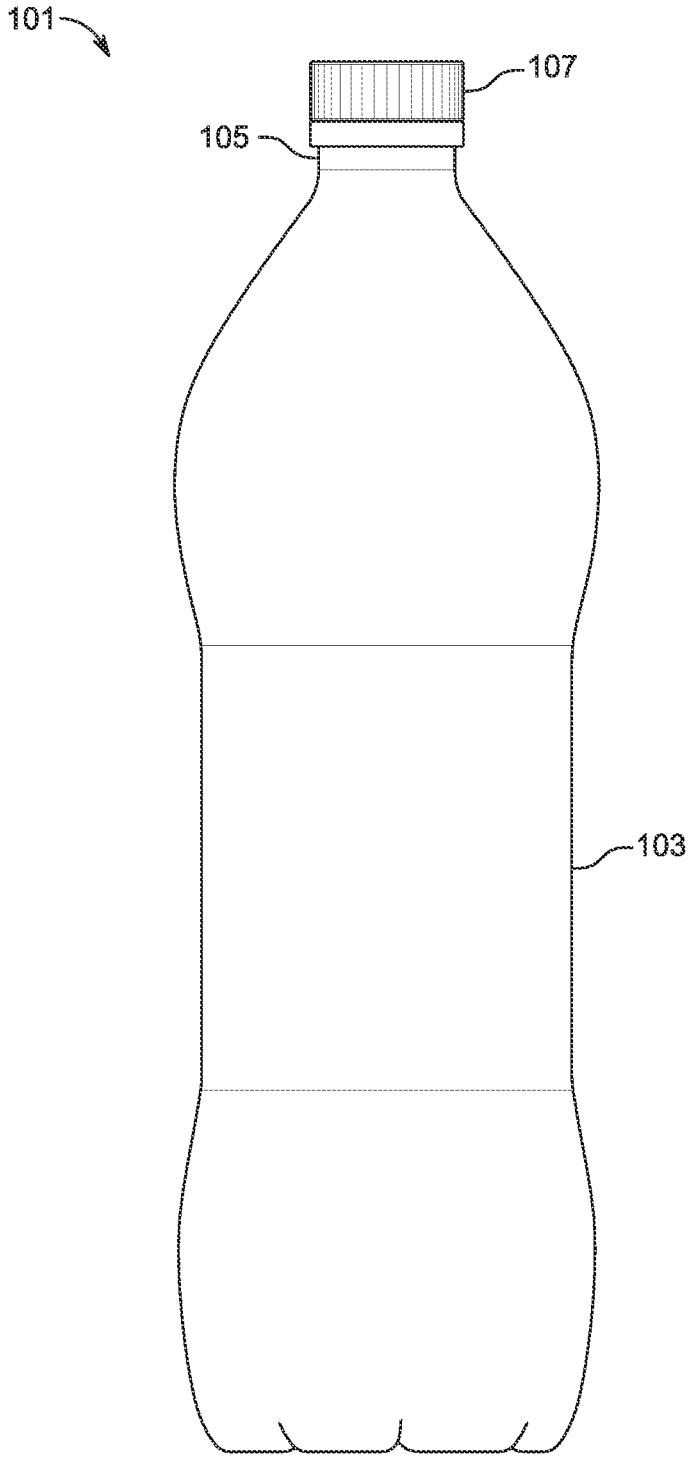
FIG. 1 PRIOR ART
FIG. 1 is a front view of a common beverage bottle.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional beverage bottles. Specifically, the present invention provides for a beverage bottle capable of disassembly, thereby allowing a user to clean the beverage bottle more effectively, thereby allowing for further reuse of the beverage bottle. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
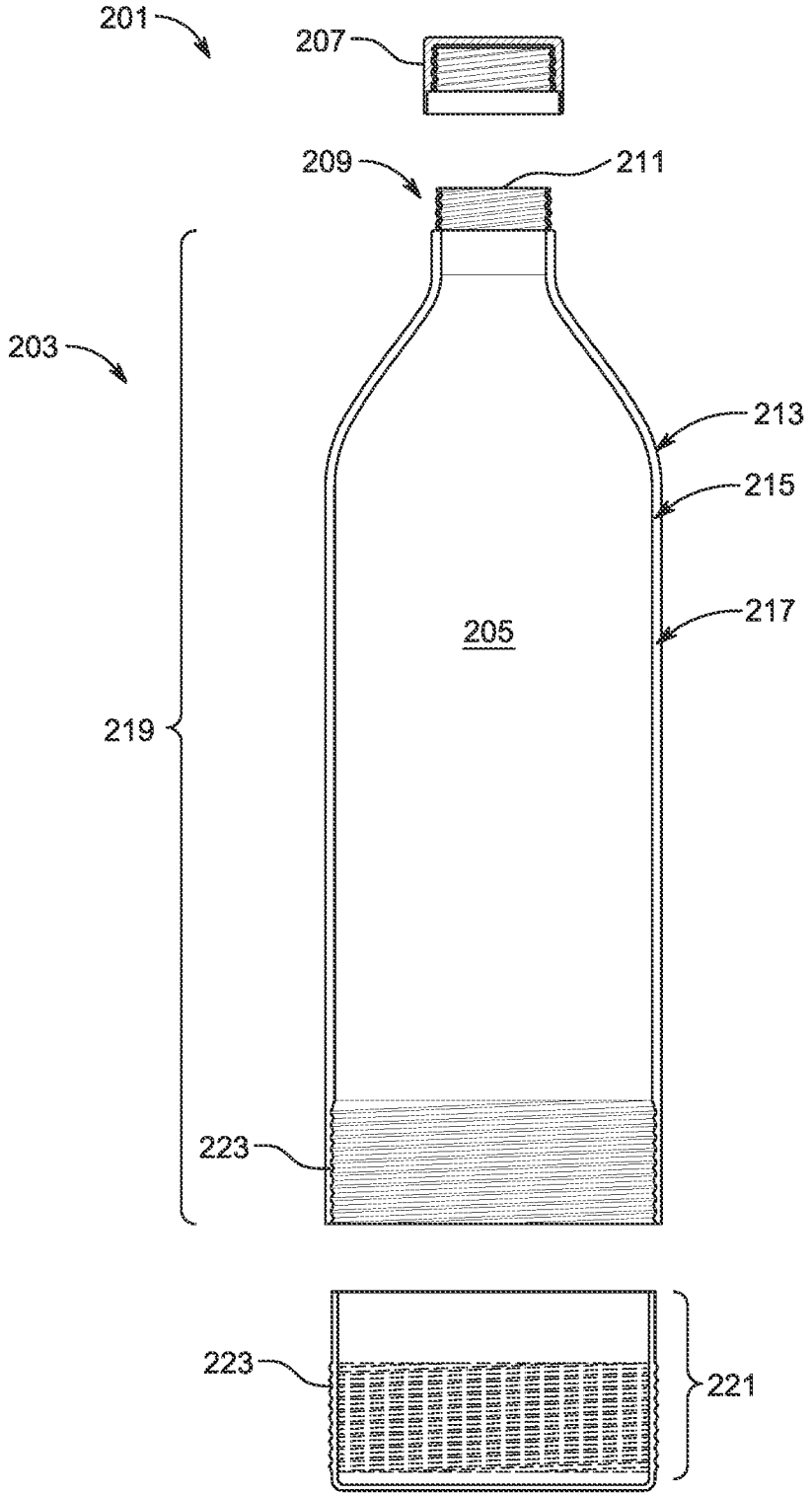
FIG. 2 is an exploded cross-sectional front view of a beverage bottle in accordance with a preferred embodiment of the present invention, illustrating the beverage bottle in a disassembled configuration.

Referring now to the drawings wherein like reference characters identify corresponding or similar elements throughout the several views, FIG. 2 depicts an exploded cross-sectional front view of a beverage bottle 201 in accordance with a preferred embodiment of the present application. It will be appreciated that the beverage bottle 201 overcomes one or more of the above-listed problems commonly associated with conventional beverage bottles.

In the contemplated embodiment, the beverage bottle 201 includes a body 203 defining an interior cavity 205 for containing a liquid and a lid 207 removably coupled to a neck portion 209 of the body 203. The neck portion 209 includes a mouth opening 211 to allow the passage of liquid to flow therefrom when the lid 207 is not engaged with the neck portion 209. It should be appreciated that the lid 207 may be removably coupled to the neck portion 209 through any suitable fastening mechanism, such as a threaded fastening mechanism (as shown in FIG. 2) or a snap-fit fastening mechanism.

The body also includes an exterior lining 213 and an interior lining 215 with an air gap 217 therebetween. It should be appreciated that the air gap 217 provides for insulation. In the preferred embodiment, the exterior lining 213 is made of stainless steel and the interior lining 215 is made of copper. In addition, in the preferred embodiment, the distance between opposing interior linings include ranges of 2.5 inches through 3 inches.

The body 203 further includes a top section 219 and a bottom section 221. The bottom section 221 is configured to removably couple to the top section 219 via a fastening mechanism 223. In the preferred embodiment, the fastening mechanism 223 is a threaded fastening mechanism. In addition, in the preferred embodiment, the top section 219 includes dimensions of 12 inches through 6 inches. Further, in the preferred embodiment, the bottom section 221 includes dimensions of 3.5 inches through 2.5 inches.

It should be appreciated that the beverage bottle 201 may vary based on aesthetical, functional, or manufacturing considerations. For example, the beverage bottle 201 can include different colored materials, patterns, images, and the like to achieve a desired aesthetic. In addition, the beverage bottle 201 can include one or more o-reals or other seals to prevent liquid from leaking or otherwise escaping from the interior cavity 205 when the lid 207 and bottom section 221 are secured to the body 203.

It should also be appreciated that one of the unique features believed characteristic of the present application is the configuration of the bottom section 221. Specifically, the volume within the bottom section 221 is deep enough so that a user can place ice, water, fruits, other liquids, etc., therein prior coupling the bottom section 221 to the top section 219.

Figure 3:
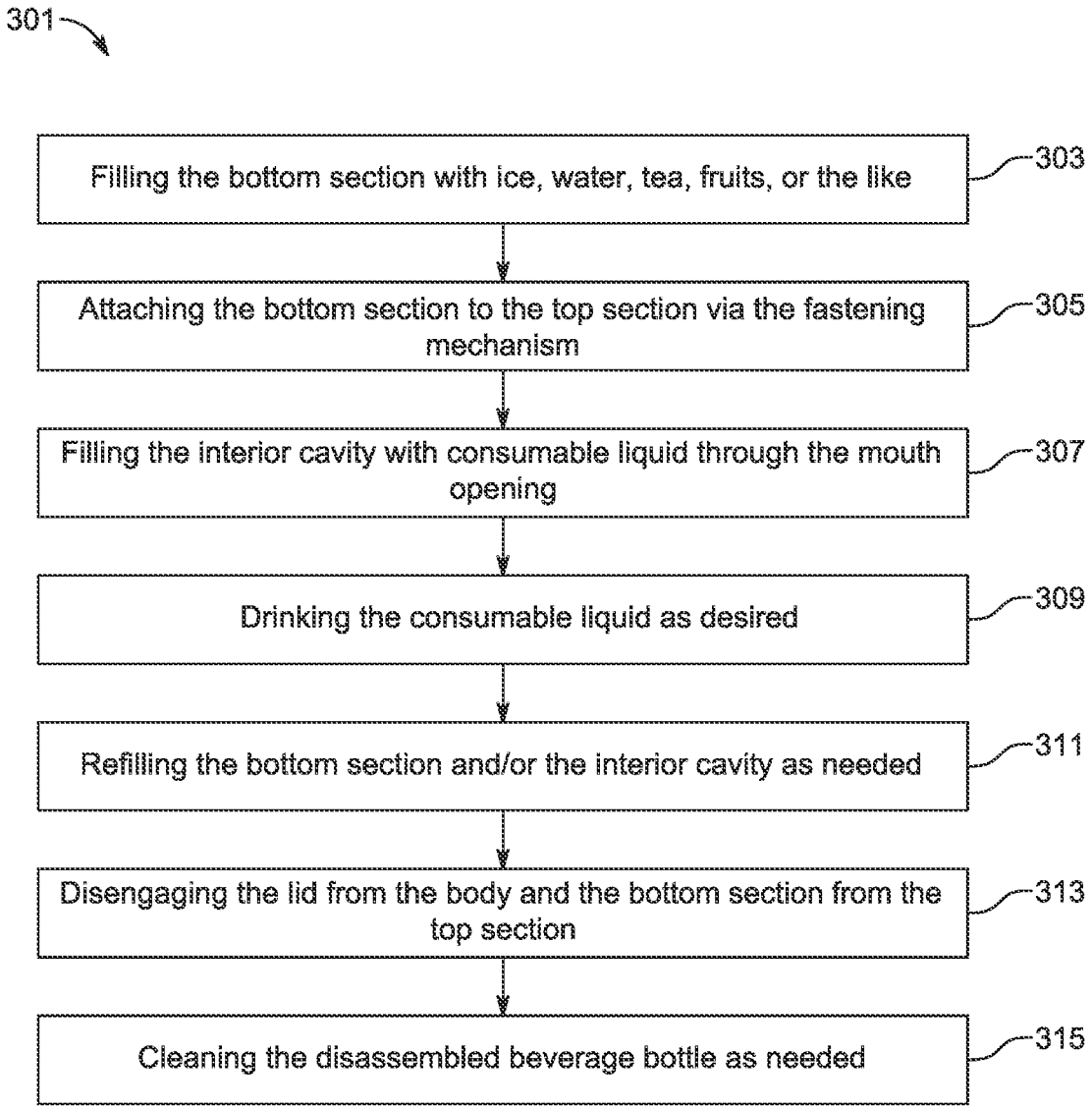
FIG. 3 is a flowchart of a method of use of the beverage bottle of FIG. 2.

In FIG. 3, a flowchart 301 depicts a simplified method of use associated with the beverage bottle 301. During use, a user can fill the bottom section with ice, water, tea, fruits, or the like and then attach the bottom section to the top section via the fastening mechanism, as shown with boxes 303, 305. The user can fill the interior cavity with consumable liquid through the mouth opening and drink therefrom as desired, as shown with boxes 307, 309. In addition, the user can refill the bottom section and/or the interior cavity as needed, as shown with box 311. Further, the user can disengage the lid from the body and the bottom section from the top section to allow for easy cleaning of the disassembled beverage bottle as needed, as shown with boxes 313, 315.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A beverage bottle, comprising:

a body defining an interior cavity adapted to contain a consumable liquid, the body having:

a neck portion having a mouth opening to allow passage of the consumable liquid to flow therefrom;

a top section;

an elongated portion having an inner surface, the elongated portion forming a first insulated area via a first air gap between the inner surface and an outer surface;

a bottom section having a bottom outer surface and configured to removably couple to the top section via a fastening mechanism, the bottom section forming a second insulated area via a second air gap between a bottom inner surface and the bottom outer surface, the fastening mechanism has a first threaded section extending from the bottom outer surface and configured to releasably engage with a second threaded section extending inwardly from the bottom inner surface of the elongated portion; and a lid configured to removably couple to the neck portion.

2. A method of disassembling a beverage bottle for cleaning, the method comprising:

providing the beverage bottle of claim 1;

disengaging the lid from the body;

disengaging the bottom section from the top section; and cleaning the body and lid to allow the beverage bottle to be reused again for containing a consumable liquid within the body and one or more consumables within the bottom section.

3. The method of claim 2, wherein the body further comprising an exterior lining and an interior lining with an air gap therebetween.

* * * * *